US009021948B2

(12) United States Patent
Pattekar et al.

(10) Patent No.: US 9,021,948 B2
(45) Date of Patent: May 5, 2015

(54) ENVIRONMENTAL CONTROL SUBSYSTEM FOR A VARIABLE DATA LITHOGRAPHIC APPARATUS

(75) Inventors: Ashish Pattekar, Cupertino, CA (US); Timothy Stowe, Alameda, CA (US); David Biegelsen, Portola Valley, CA (US); Peter Odell, Mississauga (CA)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 880 days.

(21) Appl. No.: 13/204,560

(22) Filed: Aug. 5, 2011

(65) Prior Publication Data

US 2013/0032050 A1 Feb. 7, 2013

(51) Int. Cl.

| | |
|---|---|
| ***B41F 1/18*** | (2006.01) |
| ***G03G 15/22*** | (2006.01) |
| ***B41C 1/10*** | (2006.01) |
| ***G03G 15/10*** | (2006.01) |
| *B41M 1/06* | (2006.01) |

(52) U.S. Cl.

CPC ..... *G03G 15/228* (2013.01); *B41C 1/1033* (2013.01); *B41M 1/06* (2013.01); *G03G 15/10* (2013.01); *G03G 2215/00801* (2013.01); *B41P 2227/70* (2013.01)

(58) Field of Classification Search

CPC ..... B41C 1/1033; B41C 1/1008; B41M 1/06; B41M 9/00; B41N 3/08; B41N 3/00

USPC ..... 101/141, 147, 450.1, 451, 452

See application file for complete search history.

(56) References Cited

U.S. PATENT DOCUMENTS

| | | | |
|---|---|---|---|
| 3,741,118 | A | 6/1973 | Carley |
| 3,800,699 | A | 4/1974 | Carley |
| 3,877,372 | A | 4/1975 | Leeds |

(Continued)

FOREIGN PATENT DOCUMENTS

| | | | |
|---|---|---|---|
| DE | 101 60 734 | A1 | 7/2002 |
| DE | 103 60 108 | A1 | 7/2004 |

(Continued)

OTHER PUBLICATIONS

Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).

(Continued)

*Primary Examiner* — Daniel J Colilla
*Assistant Examiner* — John M Royston
(74) *Attorney, Agent, or Firm* — Ronald E. Prass, Jr.; Prass LLP

(57) ABSTRACT

Methods and structures are disclosed to minimize the presence of vapor clouding in the path between an energy (e.g., radiation) source and the dampening fluid layer in a variable data lithography system. Also disclosed are conditions for optimizing vaporization of regions of the dampening fluid layer for a given laser source power. Conditions are also disclosed for minimizing re-condensation of vaporized dampening fluid onto the patterned dampening fluid layer. Accordingly, a reduction in the power required for, and an increase in the reproducibility of, patterning of a dampening fluid layer over a reimageable surface in a variable data lithography system are disclosed.

18 Claims, 6 Drawing Sheets

(56) References Cited

U.S. PATENT DOCUMENTS

| | | | | |
|---|---|---|---|---|
| 4,627,349 | A | 12/1986 | Claussen | |
| 4,887,528 | A | 12/1989 | Ruge | |
| 5,067,404 | A | 11/1991 | Frunder et al. | |
| 5,118,327 | A * | 6/1992 | Nelson et al. | 95/10 |
| 5,701,815 | A | 12/1997 | Bocko | |
| 5,855,173 | A | 1/1999 | Chatterjee et al. | |
| 6,125,756 | A | 10/2000 | Nussel et al. | |
| 6,146,798 | A | 11/2000 | Bringans et al. | |
| 6,318,264 | B1 | 11/2001 | D'Heureuse et al. | |
| 6,531,682 | B1 * | 3/2003 | Guttler | 219/121.84 |
| 6,561,090 | B1 | 5/2003 | Spooner | |
| 6,725,777 | B2 | 4/2004 | Katano | |
| 6,841,366 | B1 | 1/2005 | Bower et al. | |
| 6,901,853 | B2 | 6/2005 | Baldy et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,160,362 | B2 * | 1/2007 | Terada et al. | 95/210 |
| 7,191,705 | B2 | 3/2007 | Berg et al. | |
| 7,419,765 | B2 * | 9/2008 | Teltschik et al. | 430/302 |
| 7,763,413 | B2 * | 7/2010 | Ray et al. | 430/302 |
| 2003/0091363 | A1 * | 5/2003 | Hoffman et al. | 399/92 |
| 2003/0167950 | A1 | 9/2003 | Mori | |
| 2004/0011234 | A1 | 1/2004 | Figov | |
| 2005/0178281 | A1 | 8/2005 | Berg et al. | |
| 2005/0258136 | A1 | 11/2005 | Kawanishi | |
| 2006/0152566 | A1 | 7/2006 | Taniuchi | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi | |
| 2008/0202368 | A1 * | 8/2008 | Kajitani et al. | 101/350.1 |
| 2008/0223240 | A1 | 9/2008 | Drury | |
| 2010/0031838 | A1 * | 2/2010 | Lewis et al. | 101/450.1 |
| 2011/0052244 | A1 * | 3/2011 | Bennett et al. | 399/92 |

FOREIGN PATENT DOCUMENTS

| | | | |
|---|---|---|---|
| DE | 10 2006 050744 | A1 | 4/2008 |
| DE | 10 2008 062741 | | 7/2010 |
| EP | 1 935 640 | A2 | 6/2008 |
| EP | 1 938 987 | A2 | 7/2008 |
| EP | 1 964 678 | A2 | 9/2008 |
| WO | 2006/133024 | A2 | 12/2006 |
| WO | WO 2009025821 | A1 | 2/2009 |

OTHER PUBLICATIONS

Katano et al., "The New Printing System Using the Materials of Reversible Change of Wettability", International Congress of Imaging Science 2002, Tokyo, pp. 297 et seq. (2002).
Kjelgaard, M., "Humidification Side by Side", Engineered Systems Mag., (Troy, MI 2002).
Turpin, Joanna, "Ultrasonic Humidification is Ultra-Efficient", Engineered SYstems Mag., (Troy, MI 2003).
U.S. Appl. No. 13/095,714, filed Apr. 27, 2011, Stowe et al.
U.S. Appl. No. 13/095,737, filed Apr. 27, 2011, Stowe et al.
U.S. Appl. No. 13/095,745, filed Apr. 27, 2011, Stowe et al.
U.S. Appl. No. 13/095,757, filed Apr. 27, 2011, Stowe et al.
U.S. Appl. No. 13/095,764, filed Apr. 27, 2011, Stowe et al.
U.S. Appl. No. 13/095,773, filed Apr. 27, 2011, Stowe et al.
U.S. Appl. No. 13/095,778, filed Apr. 27, 2011, Stowe et al.
U.S. Appl. No. 13/204,515, filed Aug. 5, 2011, Stowe et al.
U.S. Appl. No. 13/204,526, filed Aug. 5, 2011, Stowe et al.
U.S. Appl. No. 13/204,548, filed Aug. 5, 2011, Pattekar et al.
U.S. Appl. No. 13/204,567, filed Aug. 5, 2011, Stowe et al.
U.S. Appl. No. 13/204,578, filed Aug. 5, 2011, Stowe et al.
U.S. Appl. No. 13/366,947, filed Feb. 6, 2012, Biegelsen.
U.S. Appl. No. 13/426,209, filed Mar. 21, 2012, Liu et al.
U.S. Appl. No. 13/426,262, filed Mar. 21, 2012, Liu et al.

* cited by examiner

ENVIRONMENTAL CONTROL SUBSYSTEM FOR A VARIABLE DATA LITHOGRAPHIC APPARATUS

CROSS-REFERENCE TO RELATED APPLICATIONS

The present disclosure is related to U.S. patent application titled "Variable Data Lithographic System", Ser. No. 13/095,714, filed on Apr. 27, 2011, and assigned to the same assignee as the present application, and further which is incorporated herein by reference.

BACKGROUND

The present disclosure is related to marking and printing methods and systems, and more specifically to methods and systems providing control of conditions local to the point of writing data to a reimageable surface in variable data lithographic system.

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a dampening fluid or fountain fluid (typically consisting of water and a small amount of alcohol as well as other additives and/or surfactants to reduce surface tension). The hydrophobic regions repel dampening fluid and accept ink, whereas the dampening fluid formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Also, the surface roughness of the offset blanket cylinder helps to deliver a more uniform layer of printing material to the substrate free of defects such as mottle. Sufficient pressure is used to transfer the image from the offset cylinder to the substrate. Pinching the substrate between the offset cylinder and an impression cylinder provides this pressure.

Typical lithographic and offset printing techniques utilize plates which are permanently patterned, and are therefore useful only when printing a large number of copies of the same image (long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems, where the per-page cost is typically independent of the number of copies that are printed.

Accordingly, a lithographic technique, referred to as variable data lithography, has been developed which uses a non-patterned reimageable surface coated with dampening fluid. Regions of the dampening fluid are removed by exposure to a focused heat source (e.g., using radiation such as a laser light source). A temporary pattern in the dampening fluid is thereby formed over the non-patterned reimageable surface. Ink applied thereover is retained in regions corresponding to the removal of the dampening fluid. The inked surface is then brought into contact with a substrate (such as paper), and the ink pattern transfers to the substrate. The dampening fluid may then be removed, a new, uniform layer of dampening fluid applied to the reimageable surface, and the process repeated.

The patterning of dampening fluid on the reimageable surface in variable data lithography essentially involves using a heat source such as a laser to selectively boil off or ablate the dampening fluid in selected locations. This process can be energy intensive due to the large latent heat of vaporization of water. At the same time, high-speed printing necessitates the use of high-speed modulation of the heat source, which can be prohibitively expensive for high power lasers. Therefore, from both an energy and cost perspective, it is beneficial to reduce the total amount of laser energy that is needed to achieve pattern-wise vaporization of the dampening fluid.

However, one byproduct of the pattern-wise evaporation of dampening fluid is generation of a vapor cloud. This cloud can partially absorb energy from the laser being used to write onto the dampening fluid layer, thus reducing the laser power available for patterning the dampening fluid layer.

With reference to FIG. 1, a layer 32 of dampening fluid is shown over a portion of a reimageable surface 34 carried by imaging member 12. A key requirement of dampening fluid subsystem 14 is to deliver dampening fluid such that layer 32 is of a controlled and uniform thickness. In one embodiment layer 32 is in the range of 200 nanometers (nm) to 1.0 micrometer (μm), and very uniform without defects such as pinholes. The dampening fluid itself may be composed mainly of water, optionally with small amounts of isopropyl alcohol or ethanol added to reduce its natural surface tension as well as lower the evaporation energy necessary for subsequent laser patterning. In addition, a suitable surfactant may be added in a small percentage by weight, which promotes a high amount of wetting to the reimageable surface layer. In one embodiment, this surfactant consists of silicone glycol copolymer families such as trisiloxane copolyol or dimethicone copolyol compounds which readily promote even spreading and surface tensions below 22 dynes/cm at a small percentage addition by weight. Other fluorosurfactants are also possible surface tension reducers. Optionally the dampening fluid may contain a radiation sensitive dye to partially absorb laser energy in the process of patterning. In another embodiment, the dampening fluid may be non-aqueous, comprises for example of a fluid having a low heat of vaporization.

Typically, the thickness of the dampening fluid layer cannot be lower than about 200 nm (e.g., for an aqueous dampening fluid) to ensure reliable ink selectivity between hyodrophilic and hydrophobic regions over the reimageable surface, and the consequent contrast between the image and non-image zones. This is mainly because the selectivity for ink transfer is a result of the splitting of the sacrificial dampening fluid layer from the dampened regions of the reimageable surface, and a thinner dampening fluid layer may not split reliably.

This minimum required dampening fluid layer thickness of approximately 200 nm results in a minimum per-pixel energy requirement based on the heating requirements for boiling-off the dampening fluid (e.g., water), equal to the sensible heating (i.e., heat needed to raise the temperature of the water to its boiling point, typically from a room temperature of about 20° C. to approximately 100° C., which equals the specific heat capacity times the temperature rise of approximately 80° C.) and latent heating (i.e., heat or enthalpy of vaporization of water which is about 540 calories per gram at atmospheric conditions). Based on the above information, we can calculate the power requirements for laser based vaporization of a 200 nm thick layer of water for a print speed of 100 pages per minute and a resolution of 600 dpi (42 micron pixel size and pitch), as shown in Table 1, below.

TABLE 1

| | |
|---|---|
| Resolution | 600 dpi |
| Thickness of dampening fluid layer | 0.2 microns |
| Print speed | 100 ppm |
| Dot size (diameter) | 42.33 microns |
| Dampening fluid mass per pixel | 2.81E−13 kg |
| Dampening fluid latent heat required per pixel | 1.52E−07 cal |
| Dampening fluid sensible heat required per pixel | 2.11E−08 cal |
| Total dampening fluid heat required per pixel | 1.73E−07 cal (or 7.24E−07 J) |
| Required minimum energy density | 5.14E−02 J/cm2 |
| Number of pixels in a 8.5 × 11" page | 33660000 pixels |
| Time per pixel | 1.78E−08 sec |
| Scanning laser power | 40.60 Watt |

The above are the theoretical minimum energy and power requirements for vaporization of the dampening fluid assuming that it is comprised only of water, and without accounting for heat loss into the reimageable surface or other regions of the system. It will be appreciated that a relatively high power laser source is required under ideal conditions. However, the cloud of dampening vapor resulting from prior boiling off of regions of the dampening fluid layer can absorb a significant amount of the laser source energy. Considering the presence of this cloud, higher laser power levels are needed to enable boiling-off of the regions of dampening fluid. Providing such a high power laser source may be prohibitive from a number of perspectives such as cost, energy consumption, and so on.

Furthermore, the cloud of vaporized dampening fluid can re-condense onto the fluid layer, partially filling and altering the wall profiles of the pockets created by laser writing process. This is especially true for dampening fluids containing large solids, where preferential edge development can be seen due to vapor cloud diffusion.

Still further, variations in surrounding air humidity can negatively impact the removal rate of dampening fluid from the dampening fluid layer. For example, if a water based dampening solution is used, a higher concentration of water molecules in the surrounding air results in a higher likelihood of re-condensation on areas that are intended to be free of dampening fluid, and an increase in evaporation resulting in more absorptive material interposed between the laser source and the dampening fluid layer as well as variation in layer thickness.

SUMMARY

Accordingly, the present disclosure is directed to systems and methods providing a reduction in the power required for, and an increase in the reproducibility of, patterning of a dampening fluid layer over a reimageable surface in a variable data lithography system. More specifically, mechanisms are provided, and steps are taken to minimize the presence of vapor clouding in the path between the radiation (e.g., laser) source and the dampening fluid layer. Conditions may also be controlled such that optimal conditions exist for vaporization of regions of the dampening fluid layer for a given laser source power. Conditions may further be controlled such that re-condensation of vaporized dampening fluid onto the patterned dampening fluid layer is minimized.

Systems and methods are disclosed herein for controlling the environmental conditions in a region over a surface of a dampening fluid layer proximate a location at which a radiation-based patterning subsystem selectively vaporizes portions of the dampening fluid layer in a variable data lithographic apparatus, comprising: an enclosure disposed over the surface of a dampening fluid layer and proximate the location at which the radiation-based patterning subsystem selectively vaporizes portions of the dampening fluid layer; a gas-flow control subsystem coupled to the enclosure such that a gas-flow may be controllably generated within the enclosure and proximate the location at which a radiation-based patterning subsystem selectively vaporizes portions of the dampening fluid layer; the enclosure configured to permit an output of the radiation-based patterning subsystem to exit there from and thereby be incident on the dampening fluid layer; and, the enclosure further configured to permit the gas-flow to exit the enclosure at a desired location; whereby the gas-flow may evacuate vaporized dampening fluid from a region proximate the location at which the radiation-based patterning subsystem selectively vaporizes portions of the dampening fluid layer.

Various alternate embodiments of such systems are also disclosed. Furthermore, variations and combinations of elements of these embodiments are disclosed.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment, and other well-known details are merely summarized or are omitted so as not to unnecessarily obscure the details of the present invention. Thus, where details are otherwise well known, we leave it to the application of the present invention to suggest or dictate choices relating to those details.

Figure 1:
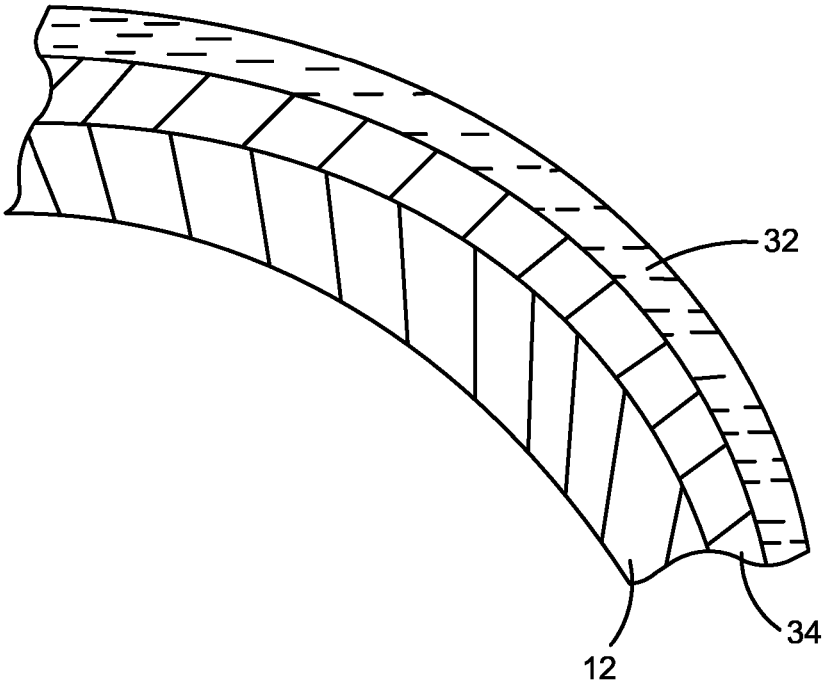
FIG. 1 (Prior Art)
FIG. 1 is a side view of an imaging member having a reimageable surface formed thereover, and a dampening fluid layer formed over the reimageable surface, as known in the art.
Figure 2:
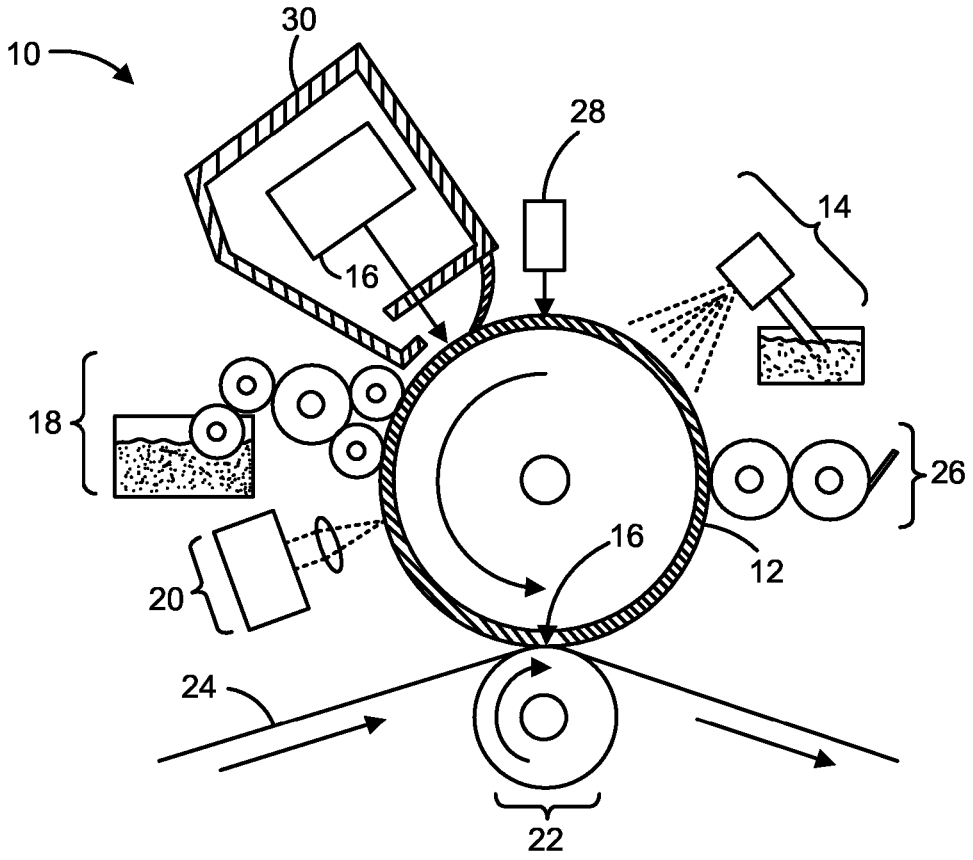
FIG. 2 is a side view of a system for variable data lithography including an imaging member, a dampening fluid subsystem, a radiation-based patterning subsystem, an inking subsystem, a rheology control subsystem, a transfer subsystem, and a surface cleaning subsystem, according to an embodiment of the present disclosure.

With reference to FIG. 2, there is shown therein a system 10 for variable data lithography according to one embodiment of the present disclosure. System 10 comprises an imaging member 12, in this embodiment a drum, but may equivalently be a plate, belt, etc., surrounded by a dampening fluid subsystem 14, heat-based (e.g., laser) patterning subsystem 16, an inking subsystem 18, a rheology (complex viscoelastic modulus) control subsystem 20, transfer subsystem 22 for transferring an inked image from the surface of imaging member 12 to a substrate 24, and finally a surface cleaning subsystem 26. Many optional subsystems may also be employed, such as a dampening fluid thickness sensor subsystem 28. In general, each of these subsystems, as well as operation of the system as a whole, are described in further detail in the aforementioned U.S. patent application Ser. No. 13/095,714.

System 10 further comprises an environmental control subsystem, configured and disposed to address a number of conditions that affect required radiation (e.g., laser) power and the "quality" of spots written in the dampening fluid layer. A first set of such conditions relates to environmental parameters proximate the dampening fluid surface that affect the laser power required for writing to the dampening fluid layer. Appropriate manipulation and control of environmental conditions such as temperature, humidity, and air flow local to the point where the thermal energy (e.g., laser beam) is incident on the dampening fluid layer may result in reduced required energy and more effective laser writing processes.

Environmental Control

It is well known that the process of boiling a liquid substance can only occur at a temperature where the vapor pressure of the liquid equals the surrounding environmental (atmospheric) pressure. This is in contrast to the process of evaporation, which can occur at other temperatures. A liquid is said to boil when it is under a condition such that bubbles of its vapor phase can spontaneously form within its bulk and be sustained upon further addition of energy. Evaporation occurs when surface molecules in the liquid phase acquire sufficient energy (either from the surrounding medium or other molecules within the liquid itself) to escape into the vapor phase.

Figure 3:
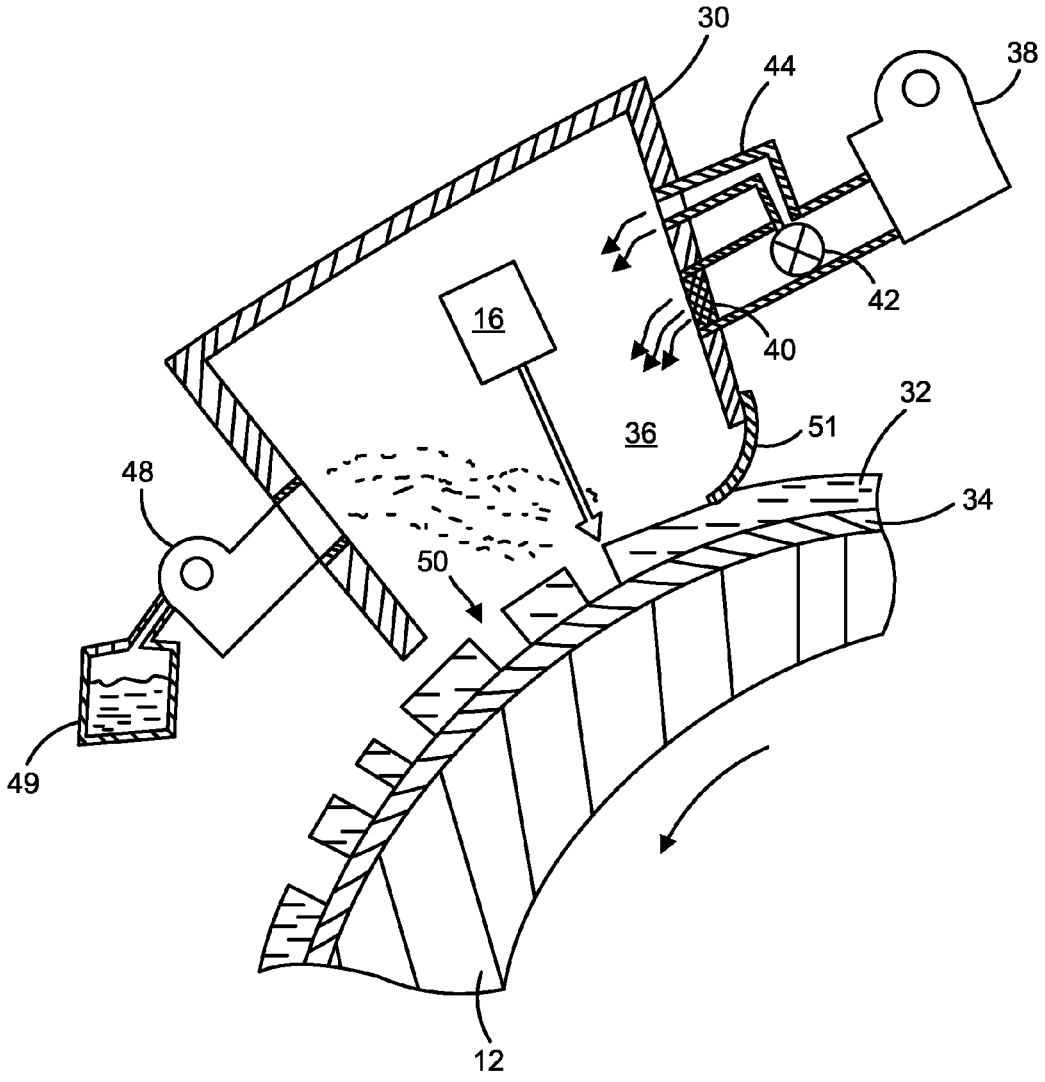
FIG. 3 is a side view of a pump-based environmental control subsystem for controlling parameters of the environment local to the point at which laser patterning subsystem writes to a dampening fluid layer, according to an embodiment of the present disclosure.

In one embodiment of the present disclosure illustrated in FIG. 3, an environmental control subsystem 30 is provide for controlling parameters of the environment local to the point at which laser patterning subsystem 16 writes to (i.e., vaporizes portions of) dampening fluid layer 32. Numerous parameters may be controlled by such a system, as illustrated in the following.

Humidity Control

A drier, less humid environment is desired since such an environment provides fewer airborne water molecules in the path of the laser, provides more effective boiling of the dampening fluid, and reduces the number of water molecules which settle into the just-formed wells 50 from which dampening fluid has been boiled off. Therefore, environmental control subsystem 30 may, in one embodiment, be an enclosure proximate imaging member 12 configured to provide a low humidity environment proximate layer 32. Laser patterning subsystem 16 may be enclosed therein. Environmental control subsystem 30 provides a dry air region 36 at least proximate the point at which a beam from laser patterning subsystem 16 is incident on dampening fluid layer 32. Dry air may be provided to region 36 from a dry air source selected from a number of options. According to one option, the dry air source may comprise an air pump (blower) 38 with a desiccator cartridge 40 attached to the pump exhaust, so that the air being pumped out is dried as the air is being provided (see, e.g., http://www.dry-air-systems.com/jetpak.html). This dry air may then be circulated within environmental control subsystem 30, proximate the surface of dampening fluid layer 32, to enhance the evaporation rate of the dampening fluid and reduce the energy requirements on laser patterning subsystem 16. In the event that a non-aqueous dampening solution is used in place of an aqueous dampening solution, dry air will help control the local partial pressure of other solventbased dampening solutions.

A valve 42 may be disposed between environmental control subsystem 30 and dry air pump 38 to control flow rate through a parallel path 44 that bypasses desiccator cartridge 40. Accordingly, the exact humidity content of the air entering the print system may be precisely controlled and tuned to achieve reliable digital printing using the selective laser removal of the dampening fluid.

Figure 4:
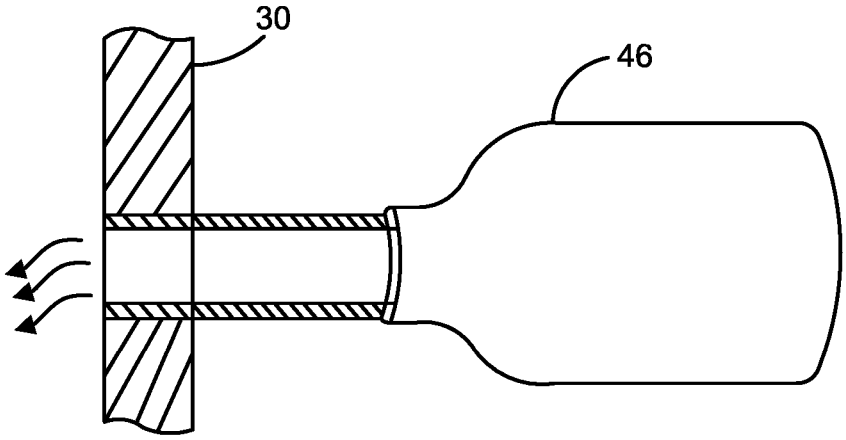
FIG. 4 is a side view of a dry gas source-based environmental control subsystem for controlling parameters of the environment local to the point at which laser patterning subsystem writes to a dampening fluid layer, according to an embodiment of the present disclosure.

According to another embodiment shown in FIG. 4, in place of pump 38 and desiccator 40, a dry gas source 46 may may be provided, for example comprising a cylinder, removably secured to environmental control subsystem 30. Cylinder 46 may contain compressed air at a desired humidity, and may provide that humidity controlled air at a constant pressure and flow rate to region 36. The need for a bypass valve, such as valve 42, is thereby obviated as the humidity of the air is set by the contents of cylinder 46.

Returning to FIG. 3, an extraction pump or similar evacuation mechanism 48 may be provide to obtain a desired gas-flow pattern, flow rate, and so on. The output of evacuation mechanism 48 may be vented to the environment, may be filtered to remove harmful components of the dampening fluid vapor, may be condensed into a storage receptacle 49 for recycling and reuse, and so on.

A dampening fluid wiper blade 51 may also be employed in association with environmental control subsystem 30. Wiper blade 51 may be used to govern the thickness of layer 32, as well as limit air entry into region 36 from upstream of the point at which layer 32 is patterned. This assists with preventing dust and other contaminants from entering region 36 and interfering with the patterning of layer 32.

Air Flow Velocity Control

Figure 5:
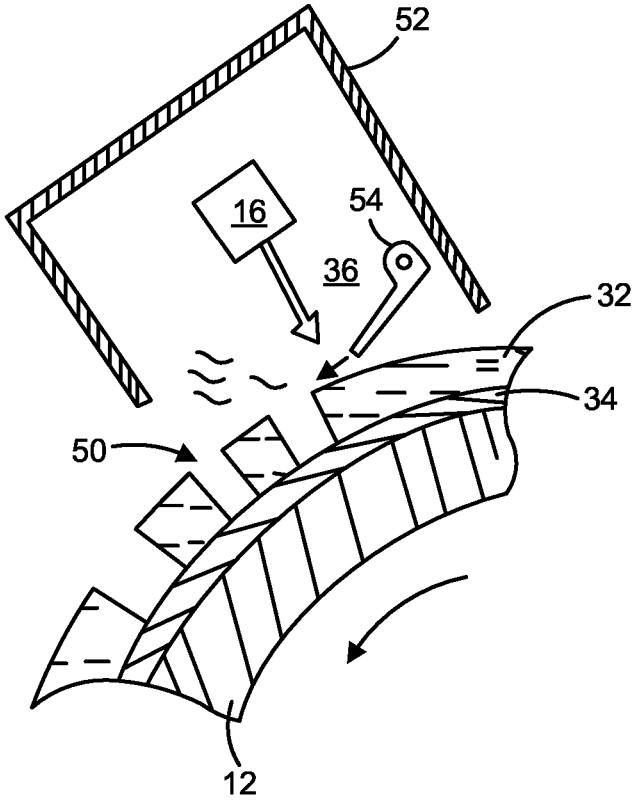
FIG. 5 is a side view of an air-knife-based environmental control subsystem for controlling parameters of the environment local to the point at which laser patterning subsystem writes to a dampening fluid layer, according to an embodiment of the present disclosure.

With reference next to FIG. 5, there is shown therein another embodiment of an environmental control subsystem 52 further comprising an air knife 54. Air knife 54 is directed to the point at which a beam from laser patterning subsystem 16 is incident on and writes to dampening fluid layer 32. Air knife 54 creates a desired airflow vector at this point. This airflow vector results in evaporating water molecules leaving the dampening fluid layer 32 being immediately carried away from their point of ejection into region 36. Thus, these water molecules will be carried away from the path of the beam generated by laser patterning subsystem 16, and further will not have a chance to re-condense on the surface of layer 32. Precise control of the air flow rate and flow direction can be used to manipulate the dampening fluid layer thickness such that the laser power requirement is optimized. Furthermore, air knife 54 may be employed with or without a combination of the humidity control embodiment described above.

Ambient and/or Surface Temperature Control

Figure 6:
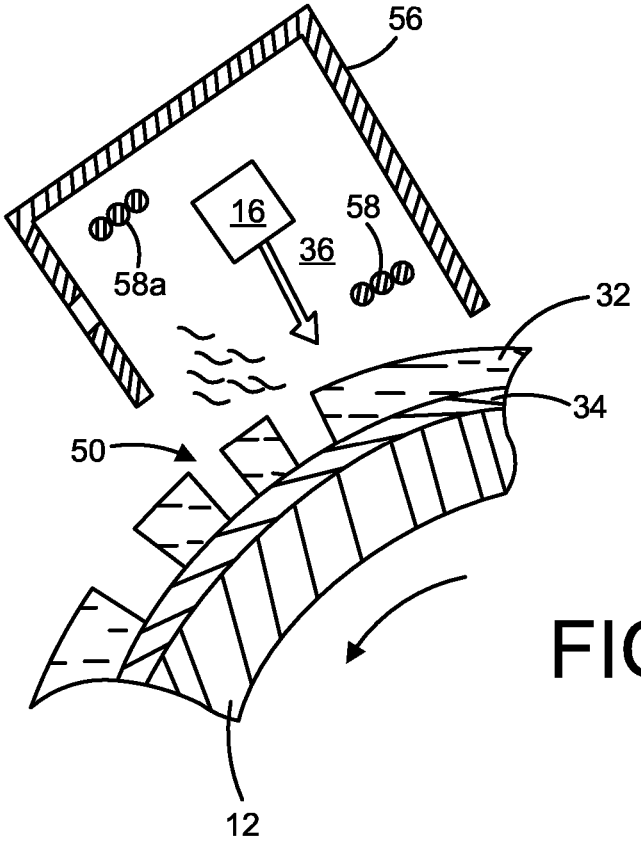
FIG. 6 is a side view of a local temperature control-based environmental control subsystem for controlling parameters of the environment local to the point at which laser patterning subsystem writes to a dampening fluid layer, according to an embodiment of the present disclosure.

With reference next to FIG. 6, there is shown therein another embodiment of an environmental control subsystem 56 further comprising a local temperature control source 58. Local temperature control source 58 may be a heating coil, heat lamp, heated (or cooled) air source, and so on. In addition, while shown within the enclosure forming environmental control subsystem 56, local temperature control source 58 may be external to the enclosure or form a portion of another element of the subsystem, such as a portion of pump 38 (FIG. 3), air knife 54 (FIG. 5), etc.

Manipulation of the temperature in region 36 may be employed to reduce laser energy required to locally vaporize a region of dampening fluid layer 32. That temperature manipulation may also enhance the dampening fluid evaporation rate. In this latter case, the water molecules that may escape into the surrounding air will be more energetic due to the temperature increase and therefore have a statistically lower chance of re-condensing onto the liquid dampening fluid layer 32. Furthermore, in response to designed temperature differentials within the enclosure of environmental control subsystem 56, such as by use of multiple temperature control sources 58, 58*a*, etc., airflow control within the enclosure can be tailored to blow the vapor away from the path of the beam from laser patterning subsystem 16.

Precise control of these temperature values may thus be utilized to maintain the dampening fluid layer evaporation rate, and corresponding dampening fluid thickness levels, such that the laser power requirement is minimized while maintaining print ink selectivity and image contrast and resolution.

Vacuum Vapor Cloud Removal

Yet another condition that may be controlled to reduce laser power requirements in a variable data lithographic system is dissipation or re-location of the cloud of vaporized dampening fluid away from the laser path. It is desired that minimal vapor be disposed between the laser source and the dampening fluid layer, and thereby minimize laser power intended for writing to the dampening fluid layer absorbed by the vapor.

Figure 7:
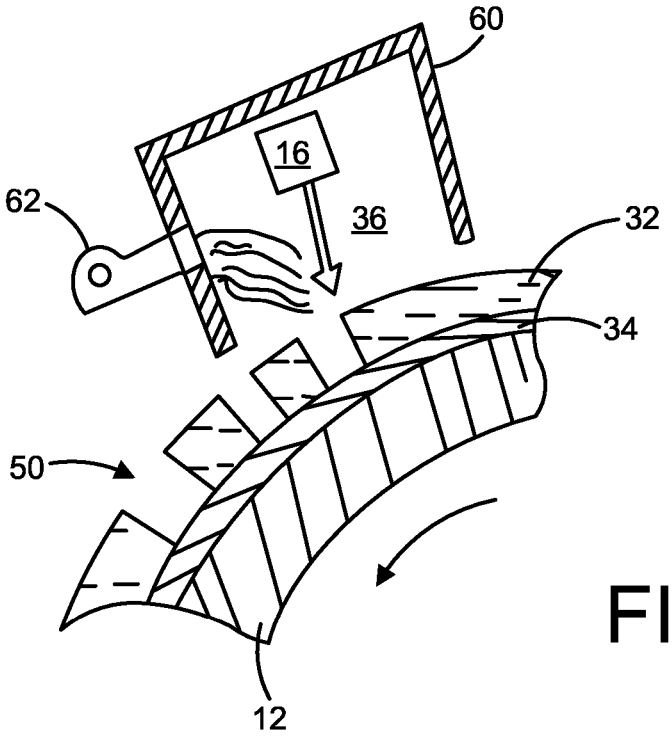
FIG. 7 is a side view of a downstream vacuum vapor removal subsystem for controlling parameters of the environment local to the point at which laser patterning subsystem writes to a dampening fluid layer, according to an embodiment of the present disclosure.

With reference to FIG. 7, there is shown therein another embodiment of an environmental control subsystem 60 further comprising a downstream vacuum vapor removal subsystem 62. Downstream vacuum vapor removal subsystem 62 may comprise a vacuum pump or other mechanism designed to draw air, and with it the vapor cloud generated by boiling off of portions of dampening fluid layer 32, from region 36. Source air may be from the ambient in and around environmental control subsystem 60 and/or may be a humidity controlled source 38 (FIG. 3), air knife 54 (FIG. 5), etc.

Figure 8:
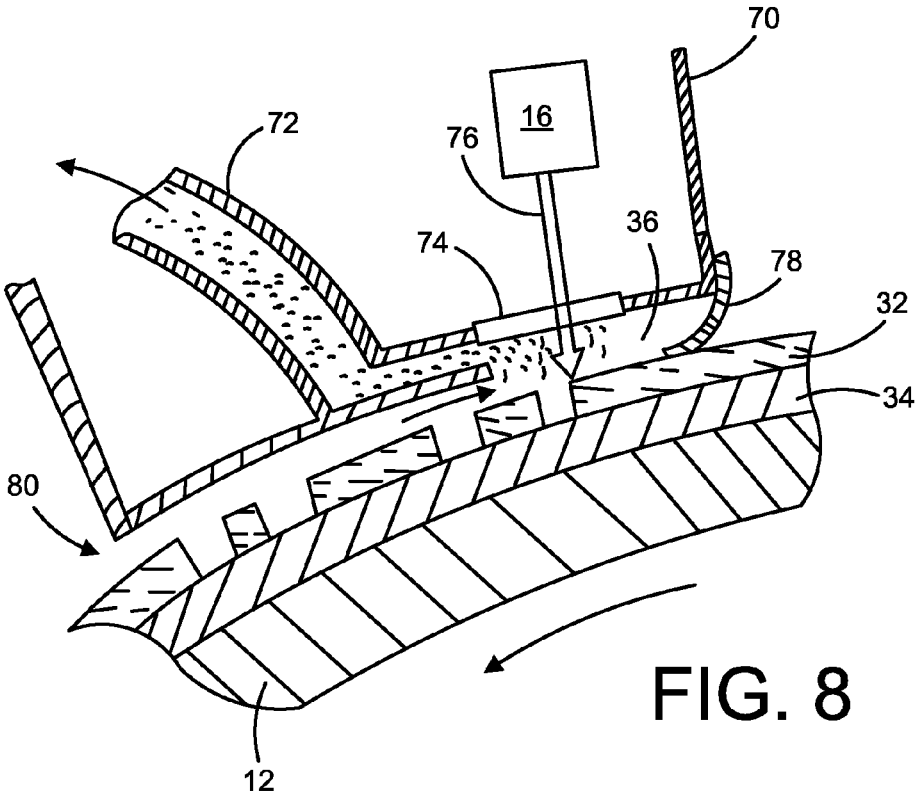
FIG. 8 is a side view of another embodiment of a downstream vacuum vapor removal subsystem for controlling parameters of the environment local to the point at which laser patterning subsystem writes to a dampening fluid layer, according to the present disclosure.

With reference to FIG. 8, another embodiment of an environmental control subsystem 70 further comprising a downstream vacuum vapor removal subsystem 72 is shown. Vacuum vapor removal system 72 extracts air from downstream of the point at which laser vaporization of layer 32 takes place. With that air is also drawn the vaporized water molecules and other components of the dampening fluid layer 32. This direction of extraction, from downstream over the patterned surface of layer 32, has the advantage of removing airborne material both from the path of beam 76 of laser patterning subsystem 16 and entrained vapor over the just-patterned region of layer 32. Thus, material that might otherwise absorb laser energy is removed as well as material that might otherwise settle back into the wells patterned in layer 32.

A dampening fluid wiper blade 78 may also be employed in association with environmental control subsystem 70. Wiper blade 78 may be used to govern the thickness of layer 32, as well as limit air entry into region 36 from upstream of the point at which layer 32 is patterned. This promotes the preferential removal of material from downstream of the point at which layer 32 is patterned as well as in the path of beam 76 of laser patterning subsystem 16, as discussed above. Wiper blade 78 also assists with preventing dust and other contaminants from entering region 36 and the path of beam 76, which may improve overall system reliability and robustness.

Further according to the embodiment of environmental control subsystem 70 shown in FIG. 8, a window structure 74, such as an anti-reflective (AR) coated laser-transparent material (e.g., glass), may be placed in the path of beam 76 of laser patterning subsystem 16, above the point of vaporization of the dampening fluid. Window structure 74 is transparent at the wavelength of emission of laser patterning subsystem 16, permitting beam 76 to pass therethrough without reducing the energy of beam 76 available for vaporizing portions of layer 32. Window structure 74 serves to prevent contamination of optics associated with producing beam 76, as well as promoting the preferential removal of material from downstream of the point at which layer 32 is patterned as well as in the path of beam 76 of laser patterning subsystem 16, as discussed above.

The embodiment of environmental control 70, as illustrated, draws ambient air at input 80 into vacuum vapor removal system 72. Alternatively, humidity-controlled air or other gas may be provided at input 80, by a system such as discussed above.

Figure 9:
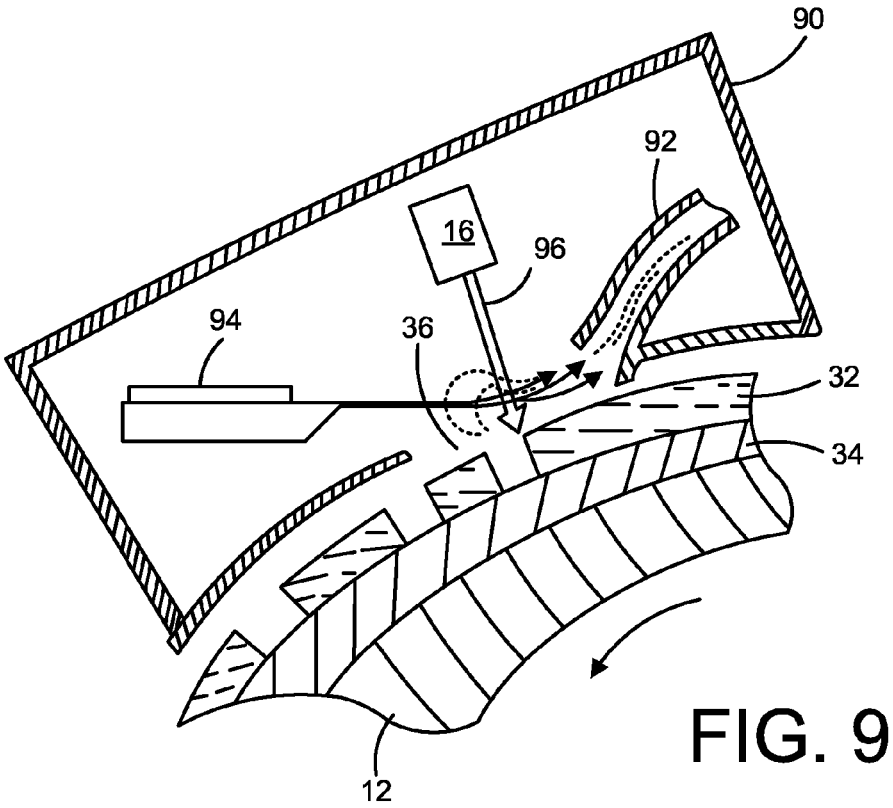
FIG. 9 is a side view of an embodiment of an upstream vacuum vapor removal subsystem with air knife for controlling parameters of the environment local to the point at which laser patterning subsystem writes to a dampening fluid layer, according to the present disclosure.

With reference to FIG. 9, another embodiment of an environmental control subsystem 90 is shown. Environmental control subsystem 90 comprises a housing to which is disposed an upstream vacuum vapor removal subsystem 92. Environmental control subsystem 90 further comprises an air knife 94 directed to the point at which a beam 96 from laser patterning subsystem 16 is incident on layer 32 to vaporize regions thereof. The air flowing from air knife 94 may be ambient air. Alternatively, the air may be humidity-controlled, as discussed above.

While vacuum vapor removal subsystem 92 is located upstream of the point at which a beam 96 from laser patterning subsystem 16 is incident on layer 32 (and thus upstream from the point of generation of the dampening fluid vapor cloud), the direction of airflow from air knife 94 results in downstream vapor being directed towards and into vacuum vapor removal subsystem 92. With appropriate positioning of air knife 94, and selection of air flow rate therefrom, any vapor generated by the boiling off of dampening fluid from layer 32 can be carried away from beam 96 and away from the downstream surface of patterned layer 32.

It will be appreciated that environmental controls, as described above, enable consistency and reproducibility in the print process. The environmental controls may be used not only to minimize the required laser power, but also to ensure that the same power is required for each unit of dampening fluid being vaporized. Furthermore, resettling of dampening fluid is reduced or eliminated, providing more uniform wells resulting from laser vaporization and more complete removal of dampening fluid from those wells for optimal ink retention therein at the inking stage.

The embodiments described above may also form part of an online feedback control mechanism that ensures that the dampening fluid layer thickness immediately prior to the point of laser exposure as well as immediately prior to the point of inking is maintained at a constant, desired level, optimized for quality printing at minimum laser energy usage. With reference again to FIG. 2, a dampening fluid thickness sensor subsystem 28 may be communicatively connected (through appropriate feedback control circuitry) to any of the environmental control subsystems described herein as an additional input for control of dampening fluid subsystem 14.

No limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A system for selectively controlling environmental conditions in an area of a surface of a dampening fluid layer disposed on an imaging member in a variable data lithographic image forming apparatus, comprising:

an enclosure disposed over a surface of a dampening fluid layer disposed on an imaging member, the enclosure substantially enclosing an area of the surface of the dampening fluid layer at which a radiation-based patterning subsystem selectively vaporizes portions of the dampening fluid layer; and a gas-flow control subsystem coupled to the enclosure that controllably generates a gas flow within the enclosure and across the area of the surface of the dampening fluid layer at which the radiation-based patterning subsystem selectively vaporizes the portions of the dampening fluid layer, the gas-flow control subsystem including a humidity control subsystem that controls a humidity of a gas generated in the area of the surface of the dampening fluid layer at which the radiation-based patterning subsystem selectively vaporizes the portions of the dampening fluid layer, the enclosure being configured (1) to permit an output of the radiation-based patterning subsystem to pass through the enclosure and to impinge on the area of the surface of the dampening fluid layer and (2) to permit the gas flow to exit the enclosure in a controlled manner at a desired location, and the gas flow evacuating the gas including vaporized dampening fluid from the area of the surface of the dampening fluid layer.

2. The system of claim 1, the humidity control subsystem, comprising:

a pump having an inlet and an outlet, the outlet of the pump being communicatively connected to the enclosure; and a desiccator material component disposed in a primary pathway for the gas flow between the outlet of the pump and the enclosure such that the gas flow from the outlet of the pump passes through the desiccator material component prior to being passed across the area of the surface of the dampening fluid layer in the enclosure.

3. The system of claim 2, the gas flow from the pump comprising air drawn from an ambient environment surrounding the variable data lithography image forming system through the inlet of the pump.

4. The system of claim 2, further comprising:

an alternate pathway for the gas flow from the outlet of the pump communicatively connecting the primary pathway and the enclosure; and a bypass valve, disposed in the primary pathway that redirects at least a portion of the gas flow provided by the pump to the alternate pathway, to provide valve-operated humidity control for the gas flow through the enclosure and across the area of the surface of the dampening fluid layer.

5. The system of claim 1, further comprising an evacuation mechanism that is communicatively coupled to the enclosure for assisting with the evacuating the gas flow and the vaporized dampening fluid from the area of the surface of the dampening fluid layer.

6. The system of claim 5, further comprising a condensation mechanism for condensing the evacuated vaporized dampening fluid for recycling and reuse.

7. The system of claim 1, further comprising a wiper blade secured to the enclosure and disposed at a leading edge of the enclosure, relative to a direction of motion of the dampening fluid layer, the wiper blade governing a thickness of the dampening fluid layer, and limiting entry of at least one of air and contaminants into the enclosure and in the area of the surface of the dampening fluid layer.

8. The system of claim 1, the gas-flow control subsystem further comprising an air knife.

9. The system of claim 1, further comprising a local temperature control source that controls an environmental temperature within the enclosure and in the area of the surface of the dampening fluid layer.

10. The system of claim 9, the local temperature control source being located within the enclosure.

11. The system of claim 10, the local temperature control source being selected form a group consisting of: a heating coil, a heat lamp, a heated air source, and a cooled air source.

12. The system of claim 1, the gas-flow control subsystem further comprising a vacuum vapor removal subsystem communicatively coupled to the enclosure downstream in the gas flow direction from the area of the surface of the dampening fluid layer relative to motion of the dampening fluid layer.

13. The system of claim 12, air upstream from the area of the surface of the dampening fluid layer relative to motion of the dampening fluid layer being prevented from entering the gas flow, and air downstream from the area of the surface of the dampening fluid layer relative to motion of the dampening fluid layer being preferentially directed into the gas flow.

14. The system of claim 1, further comprising a window structure coupled to the enclosure, the window structure being disposed between the radiation-based patterning subsystem and the area of the surface of the dampening fluid layer at which the radiation-based patterning subsystem selectively vaporizes the portions of the dampening fluid layer, such that radiation emitted by the radiation-based patterning subsystem passes through the window structure prior to impinging on the dampening fluid layer, the window structure preventing contamination of optics associated with the radiation-based patterning subsystem by vaporized portions of the dampening fluid layer.

15. The system of claim 1, the gas-flow control subsystem further comprising:

an air knife subsystem disposed within the enclosure and downstream from the area of the surface of the dampening fluid layer at which the radiation-based patterning subsystem selectively vaporizes the portions of the dampening fluid layer, such that an air knife gas flow formed by the air knife subsystem is directed toward the area of the surface of the dampening fluid layer in a direction into relative motion of the dampening fluid layer; and a vacuum vapor removal subsystem disposed within the enclosure and upstream and opposite from the air knife subsystem relative the area of the surface of the dampening fluid layer at which the radiation-based patterning subsystem selectively vaporizes the portions of the dampening fluid layer.

16. A system for selectively controlling environmental conditions in an area of a surface of a dampening fluid layer disposed on an imaging member in a variable data lithographic image forming apparatus, comprising:

an enclosure disposed over a surface of a dampening fluid layer disposed on an imaging member, the enclosure substantially enclosing an area of the surface of the dampening fluid layer at which a radiation-based patterning subsystem selectively vaporizes portions of the dampening fluid layer;

a gas-flow control subsystem coupled to the enclosure that controllably generates a gas flow within the enclosure and across the area of the surface of the dampening fluid layer at which the radiation-based patterning subsystem selectively vaporizes the portions of the dampening fluid layer, comprising:

a humidity control subsystem that controls a humidity of a gas forming the gas flow through the enclosure;

a temperature control subsystem that controls the temperature across the area of the surface of the dampening fluid layer;

an evacuation mechanism communicatively coupled to the enclosure that substantially evacuates the gas flow and vaporized dampening fluid from the area of the surface of the dampening fluid layer at which the radiation-based patterning subsystem selectively vaporizes the portions of the dampening fluid layer.

17. The system of claim 16, further comprising:

a wiper blade secured to the enclosure and disposed at a leading edge of the enclosure, relative to a direction of motion of the dampening fluid layer, the wiper blade governing a thickness of the dampening fluid layer, and limiting air entry into the enclosure and in the area of the surface of the dampening fluid layer; and a window structure coupled to the enclosure, the window structure being disposed between the radiation-based patterning subsystem and the area of the surface of the dampening fluid layer at which the radiation-based patterning subsystem selectively vaporizes the portions of the dampening fluid layer, such that radiation emitted by the radiation-based patterning subsystem passes through the window structure prior impinging on the dampening fluid layer, the window structure substantially preventing contamination of optics associated with the radiation-based patterning subsystem by vaporized portions of the dampening fluid layer.

18. A variable data lithographic image forming system, comprising:

an imaging member having an arbitrarily reimageable surface;

a dampening fluid subsystem that applies a layer of dampening fluid to the arbitrarily reimageable surface;

a patterning subsystem that selectively removes portions of the dampening fluid layer to produce a latent image in the dampening fluid layer;

an environmental control subsystem, comprising:

an enclosure disposed over an area of the reimageable surface, the enclosure having a window structure disposed in the enclosure and the enclosure being configured to permit an output of the patterning subsystem to pass through the enclosure and to impinge on the area of the surface of the dampening fluid layer for the selective removal of portions of the dampening fluid layer to produce the latent image in the dampening fluid layer;

a gas-flow control subsystem coupled to the enclosure to controllably generate a gas flow within the enclosure and in the area of the surface of the dampening fluid layer at which the radiation-based patterning subsystem selectively vaporizes the portions of the dampening fluid layer to evacuate vaporized dampening fluid from the area of the surface of the dampening fluid layer; and a humidity control subsystem that controls a humidity of a gas forming the gas flow through the enclosure; and an inking subsystem for applying ink over the arbitrarily reimageable surface layer such that the ink selectively occupies regions of the reimageable surface layer where dampening fluid is removed by the patterning subsystem to produce an inked latent image; and an image transfer subsystem for transferring the inked latent image to an image receiving media substrate.

* * * * *